US011020758B2

(12) United States Patent
Jiang

(10) Patent No.: US 11,020,758 B2
(45) Date of Patent: Jun. 1, 2021

(54) DEVICE AND METHOD FOR FUEL INJECTION USING SWIRL BURST INJECTOR

(71) Applicant: University of Louisiana at Lafayette, Lafayette, LA (US)

(72) Inventor: Lulin Jiang, Lafayette, LA (US)

(73) Assignee: University of Louisiana at Lafayette, Lafayette, LA (US)

( * ) Notice: Subject to any disclaimer, the term of this patent is extended or adjusted under 35 U.S.C. 154(b) by 0 days.

(21) Appl. No.: 15/656,456

(22) Filed: Jul. 21, 2017

(65) Prior Publication Data

US 2018/0029054 A1 Feb. 1, 2018

Related U.S. Application Data

(60) Provisional application No. 62/365,040, filed on Jul. 21, 2016.

(51) Int. Cl.

| | |
|---|---|
| ***B05B 7/00*** | (2006.01) |
| ***B05B 1/34*** | (2006.01) |
| ***F23D 11/00*** | (2006.01) |
| ***F23D 11/38*** | (2006.01) |

(Continued)

(52) U.S. Cl.

CPC ..... *B05B 7/0006* (2013.01); *B05B 1/3405* (2013.01); *F23D 11/007* (2013.01); *F23D 11/107* (2013.01); *F23D 11/12* (2013.01); *F23D 11/383* (2013.01); *F23C 2900/99009* (2013.01)

(58) Field of Classification Search

CPC ... B05B 7/0006; B05B 7/0466; B05B 1/3405; B05B 1/3426; B05B 11/11; F23D 11/00; F23D 11/07; F23D 11/12; F23D 11/38; F23D 11/383; F02M 61/162

USPC ..... 239/5, 8, 406, 463, 466, 533.1, 533.2; 431/182–185

See application file for complete search history.

(56) References Cited

U.S. PATENT DOCUMENTS 1,954,873 A * 4/1934 Gwathmey ..... F23D 14/00 239/404

2,084,708 A * 6/1937 Sherman ..... F23D 11/001 239/406

(Continued)

*Primary Examiner* — Joseph A Greenlund

(74) *Attorney, Agent, or Firm* — Jessica C. Engler; Russel O. Primeaux; Kean Miller LLP

(57) ABSTRACT

Flow blurring injection utilizes a two-phase concept to generate fine sprays immediately at the interior exit, rather than a typical jet which gradually disintegrates into ligaments and then finer droplets for a conventional injector. Therefore, clean combustion is achieved with the FB injection for fuels with distinct properties without fuel preheating or hardware modification. However, in addition to the droplets, the FB injection also produces ligaments for highly viscous liquids and relatively larger droplets at spray edge, resulting in difficulty in sustaining the flame and performs incomplete combustion and higher emissions close to the combustor all. The disclosed swirl burst injector and method utilizes the advantages of FB injection and swirl atomization to further improve atomization, and overcomes the limitations of FB injection, providing a sustainable way to use both conventional and alternative fuels with improved efficiency and minimized emissions. The fine atomization of the present invention can be also used in various applications where fine sprays are needed.

12 Claims, 18 Drawing Sheets

(51) Int. Cl.
*F23D 11/12* (2006.01)
*F23D 11/10* (2006.01)

(56) References Cited

U.S. PATENT DOCUMENTS 2,527,503 A * 10/1950 Sinclair ..... F23D 11/402 239/288.5
2,530,617 A * 11/1950 Kirk ..... F23D 17/002 239/400
2,855,033 A * 10/1958 Furczyk ..... F23D 14/125 239/406
2,976,919 A * 3/1961 Sanborn ..... F23D 11/408 239/406
3,007,515 A * 11/1961 Furdock ..... F23D 11/408 239/406
3,100,084 A * 8/1963 Biber ..... F23D 11/383 239/463
3,116,017 A * 12/1963 Kucmerosky ..... F23D 11/24 239/404
3,391,981 A * 7/1968 Voorheis ..... F23C 7/006 431/185
3,477,647 A * 11/1969 Sharpe ..... F23D 11/10 239/468
3,758,259 A * 9/1973 Voorheis ..... F23D 11/107 431/9
3,790,086 A * 2/1974 Masai ..... B05B 7/0466 239/406
3,804,333 A * 4/1974 Kramer ..... F23G 7/05 239/124
3,831,854 A * 8/1974 Sato ..... F23R 3/14 239/406
3,844,484 A * 10/1974 Masai ..... F23D 11/107 239/404
3,945,574 A * 3/1976 Polnauer ..... B05B 7/10 239/404
4,261,517 A * 4/1981 Hopkins ..... F23D 11/007 239/406
4,271,675 A * 6/1981 Jones ..... F23R 3/14 60/737
4,644,878 A * 2/1987 Nodd ..... F23D 1/005 110/264
4,798,330 A * 1/1989 Mancini ..... F23D 11/10 239/125
5,086,979 A * 2/1992 Koblish ..... F23D 11/107 239/404
5,144,804 A * 9/1992 Koblish ..... F23D 11/107 60/740
5,228,624 A * 7/1993 Mensink ..... B05B 7/10 239/405
5,513,798 A * 5/1996 Tavor ..... B05B 7/0475 239/405
5,827,054 A * 10/1998 Sarv ..... F23C 7/004 431/184
5,868,321 A * 2/1999 Haruch ..... B05B 1/3436 239/399
5,921,470 A * 7/1999 Kamath ..... F23D 11/001 239/399
5,934,555 A * 8/1999 Dobbeling ..... B05B 1/3442 239/11
6,141,967 A * 11/2000 Angel ..... F23R 3/14 239/405
6,267,301 B1 * 7/2001 Haruch ..... B05B 7/0458 239/290
6,289,677 B1 * 9/2001 Prociw ..... F23C 7/002 60/748
6,371,387 B1 * 4/2002 Nally ..... F02M 69/047 239/406
6,539,724 B2 * 4/2003 Cornwell ..... F23D 11/383 60/776
6,560,964 B2 * 5/2003 Steinhorsson ..... F23D 11/107 60/740
6,578,777 B2 * 6/2003 Bui ..... B05B 7/0475 239/406
6,755,347 B1 * 6/2004 Holz ..... F02M 61/162 239/491
7,735,756 B2 * 6/2010 Schindler ..... B05B 1/3436 239/490
7,886,995 B2 * 2/2011 Togashi ..... B65D 83/20 239/463
8,316,644 B2 * 11/2012 Wilbraham ..... F23R 3/286 60/748
8,579,213 B2 * 11/2013 Myers ..... B05B 1/06 239/492
8,579,214 B2 * 11/2013 Headland ..... F23C 7/004 239/494
8,807,457 B2 * 8/2014 Songbe ..... B05B 1/3436 239/469
8,915,307 B2 * 12/2014 Lelic ..... A62C 35/023 169/37
9,027,854 B2 * 5/2015 Moser ..... B05B 15/40 239/462
9,103,547 B2 * 8/2015 Eroglu ..... F23C 7/002
2005/0130089 A1 * 6/2005 Oda ..... F23R 3/286 431/183
2005/0279862 A1 * 12/2005 Mao ..... F23R 3/14 239/403
2007/0075165 A1 * 4/2007 Feldman ..... B05B 1/3405 239/461
2013/0233946 A1 * 9/2013 Kobayashi ..... F02M 61/162 239/403
2014/0110504 A1 * 4/2014 Honeyands ..... B05B 7/045 239/418
2015/0108236 A1 * 4/2015 Buelow ..... F23R 3/286 239/5
2015/0300634 A1 * 10/2015 Kiener ..... F23D 14/78 431/183
2016/0107914 A1 * 4/2016 Baker ..... F23D 14/48 432/13
2016/0252246 A1 * 9/2016 Arakawa ..... F23C 7/004 431/185
2016/0356253 A1 * 12/2016 Noguchi ..... F02M 61/184
2018/0029054 A1 * 2/2018 Jiang ..... F23D 11/007

* cited by examiner

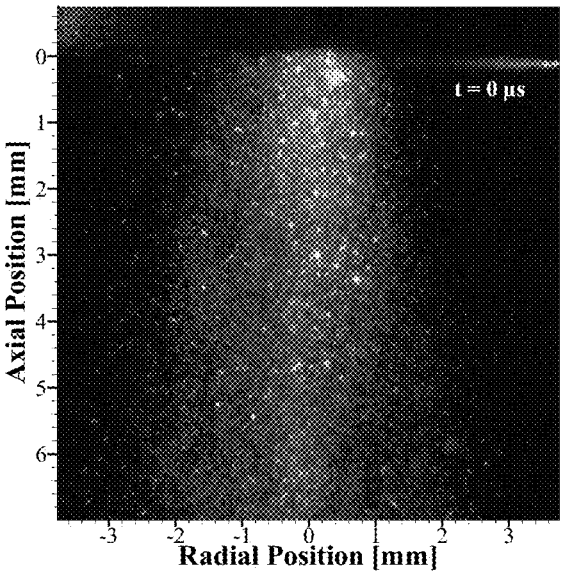
FIGURE 3(a)
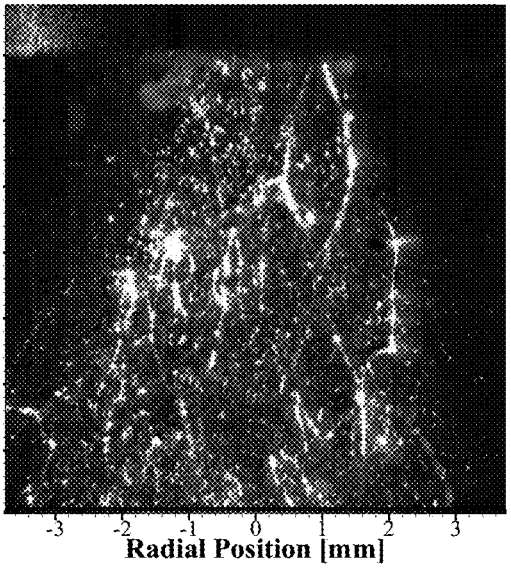
FIGURE 3(b)
FIGURE 4
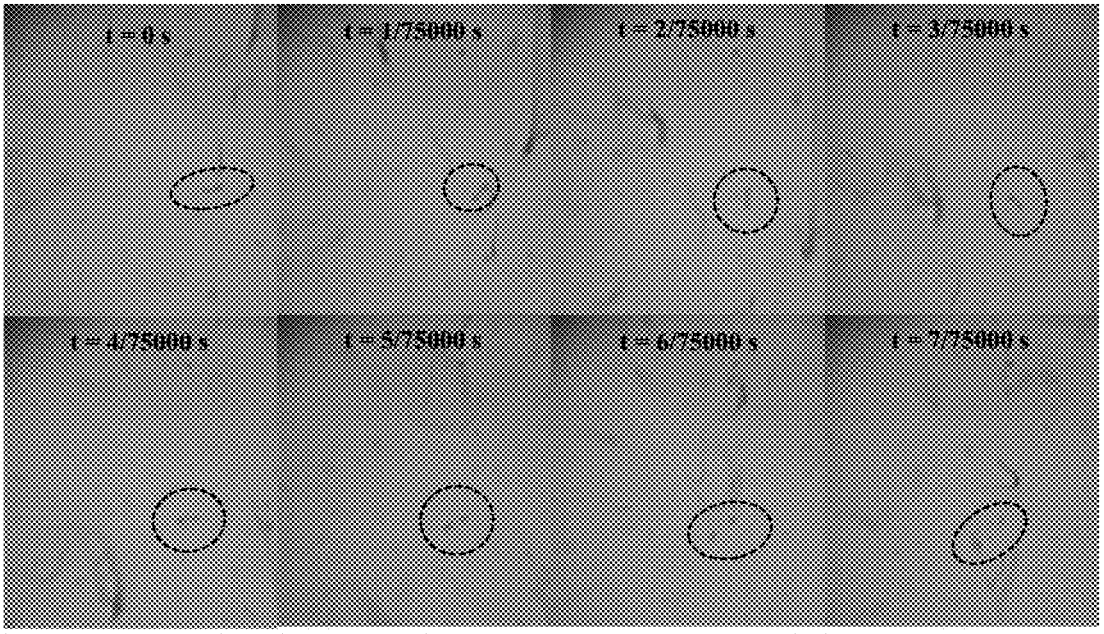

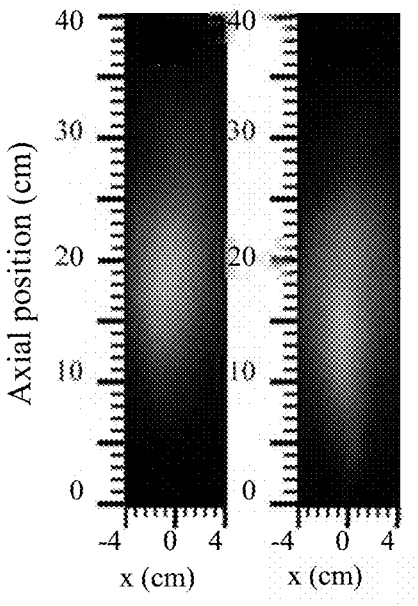
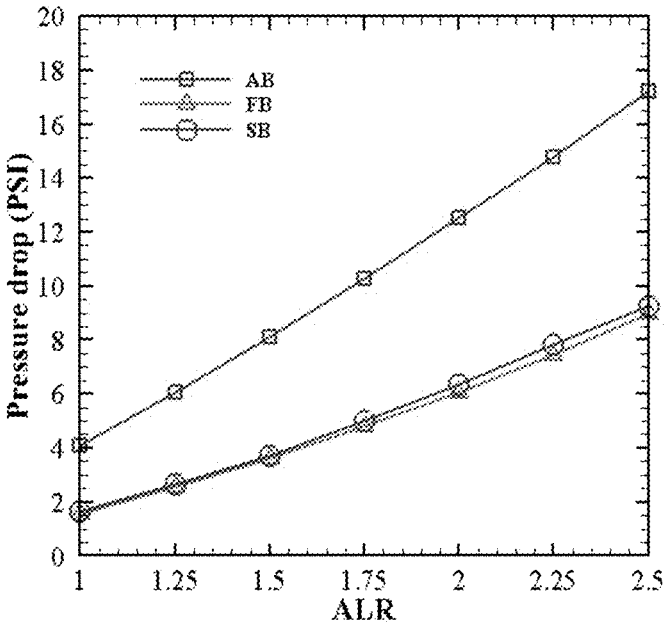
FIGURE 8(a) FIGURE 8(b) FIGURE 8(c)

DEVICE AND METHOD FOR FUEL INJECTION USING SWIRL BURST INJECTOR

CROSS REFERENCE TO RELATED APPLICATIONS

This application claims priority to and the benefit of U.S. Provisional Patent Application Ser. No. 62/365,040, filed on Jul. 21, 2016, titled the "Swirl Burst Injector."

STATEMENT REGARDING FEDERALLY SPONSORED RESEARCH OR DEVELOPMENT

Not applicable.

REFERENCE TO A "SEQUENCE LISTING", A TABLE, OR COMPUTER PROGRAM

Not applicable.

DESCRIPTION OF THE DRAWINGS

FIG. 2(*b*) provides a radial position versus axial position image of the FB spray at the same flow conditions as those in FIG. 2(*a*).

FIG. 3(*a*) provides a radial position versus axial position of the FB spray images of water at an atomizing air-to-liquid ratio (ALR) of 2.0.

FIG. 3(*b*) provides a radial position versus axial position of the FB spray image of glycerol at ALR=2.0.

FIG. 4 depicts an image sequence illustrating the breakup of short streaks into droplets with the time interval of 1/75000 seconds in the field of view (FOV) of 1.8 mm×2.0 mm for a FB spray.

FIG. 5(*b*) provides a drawing of the swirling atomizing air path for the disclosed swirl burst injector.

FIG. 6(*b*) depicts the design of the swirl burst injector with counter-swirling of the path 1 from the swirling path 2.

FIG. 7(*b*) shows a finer water spray generated by the disclosed SB injector compared to a FB injector at the identical flow rates and same injector diameter.

FIG. 8(*a*) shows the flame images of the combustion of viscous straight vegetable oil (VO) at ALR=3.5 using FB injector, without fuel preheating.

FIG. 8(*b*) shows the flame images of the combustion of viscous straight VO at ALR=3.5 using SB injector, without fuel preheating.

FIG. 8(*c*) provides a graph of the pressure drop of atomizing air line across the conventional air-blast (AB) injector, flow-blurring (FB) injector and the disclosed herein swirl-burst (SB) injector at the same flow rates as a function of atomizing air to liquid mass ratio (ALR) through the particular injectors.

FIG. 9(*b*) is the flame image for combustion of straight VO using the SB injector at an air to liquid mass ratio (ALR) of 3.5 with a shorter dark region upstream of the flame with a length of approximately 3 centimeters from the injector exit plane.

FIG. 9(*c*) is the flame image for combustion of straight VO using the SB injector at an air to liquid mass ratio (ALR) of 4.0, which has a more lifted blue flame with a dark fuel pre-vaporization zone of approximately 6 centimeters long.

FIG. 14(*b*) depicts the visual flame images of the combustion of algae oil (AO) using the swirl burst injectors with a SN of 2.0 at an ALR of 4.0 and constant flow rates.

FIG. 14(*c*) depicts the visual flame images of the combustion of algae oil (AO) using the swirl burst injectors with a SN of 2.5 at an ALR of 4.0 and constant flow rates.

FIELD OF THE INVENTION

Figure 1:
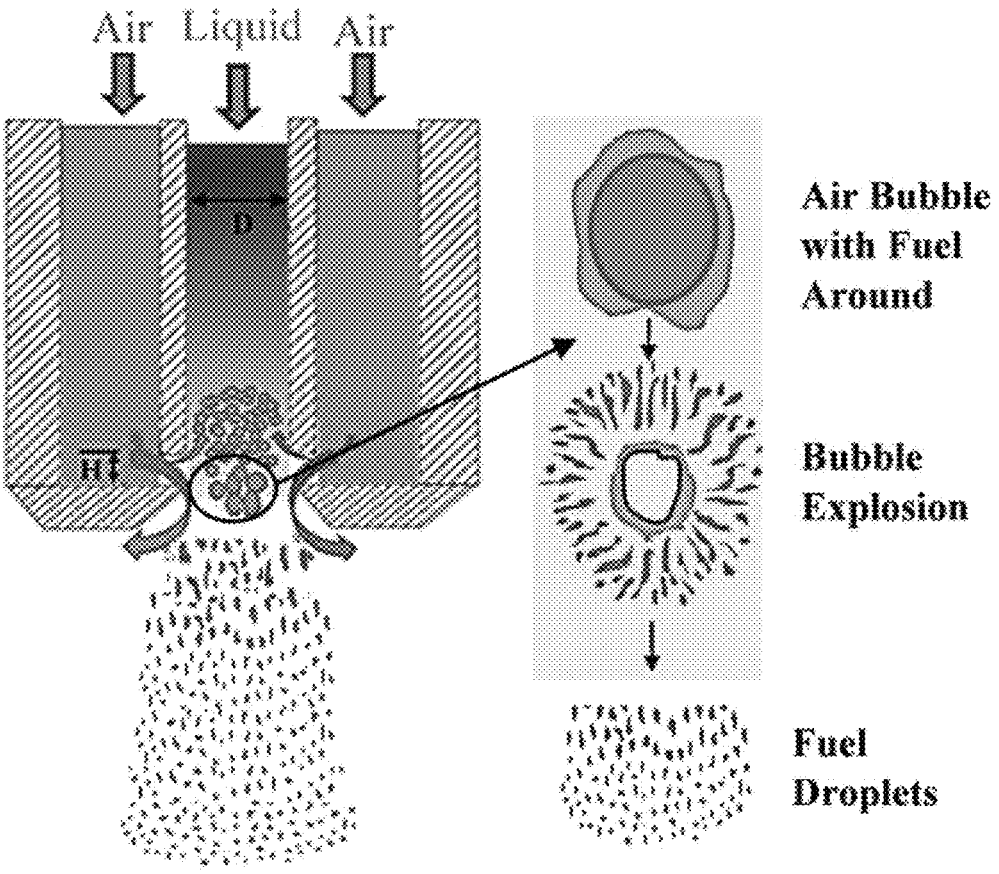
FIG. 1 provides a drawing demonstrating the working principle of the flow blurring (FB) injector.

The present invention generally relates to the field of injection and spray systems, specifically to systems and methods to enhance atomization of liquids including fuel sprays for combustion, effective injection for fire suppression and for food processing, sprays for medical use, and atomization of viscous polymer. More particularly, the invention relates to the generation of fine sprays for liquids with a wide range of viscosities.

BACKGROUND OF THE INVENTION

Liquid injectors are employed in a variety of applications including fuel combustion for electric power generation, military and civil aviation, and other transportation. Effective atomization is also desired in the areas of meteorology, food processing, fire suppression, medical use such as a mist drug delivery nebulizer, and polymer sprays in material sciences.

The dramatic increase in energy utilization and aggravating global warming conditions have motivated stricter emission standards, and thus require efficient and clean fuel consumption. In order to satisfy stricter emission standard and increasing energy demand, it is imperative that consumers use fuels more efficiently and cleanly, and explore renewable energy resources including biofuels.

Biofuels are believed to reduce up to 90 percent greenhouse gas (GHG) emissions. Biodiesel is the most common alternative drop-in vehicle fuel because of its similarities to diesel fuel, including the closed-carbon cycle and low GHG effect. However, the widespread usage of biodiesel fuels is limited, primarily due to high production cost by converting viscous source oils such as vegetable oils (VO) or other feedstock to biodiesel and the cost of coping with the highly viscous waste byproduct—glycerol. Clean and complete combustion of liquid fuels strongly relies upon spray fineness for faster fuel evaporation, properly mixed fuel-air mixture, and the subsequent and efficient clean premixed combustion. Also, the fluctuating oil price and high cost of biofuels obstruct the widespread utilization of renewable fuels. Application of other bio-oils is often impractical primarily due to of the high viscosity and limitations of present fuel injection systems, which cannot finely atomize and cleanly combust viscous fuels.

Conventional injectors first generate a liquid jet, such as in air blast injectors, or a sheet, as in pressure swirl atomizers. The jet or sheet gradually disintegrates into ligaments and ultimately small liquid drops at further downstream. In the present art, air blast (AB) injectors aerodynamically generate fuel sprays by shear layer instabilities between the liquid stream and the high speed atomizing air. The liquid jet exiting the air blast injector exit gradually breaks down into droplets downstream while interacting with the air. Air blast injection is commonly used for low-viscosity fuels such as diesel and biodiesel. However, highly increased viscosities of heavy bio-oils or other heavy fossil fuels suppress the shear layer instabilities used by conventional air blast atomization, resulting in inferior atomization and subsequent unclean flames. Pressure atomizers and pressure swirl injectors respectively employ high pressure and swirling fluid interactions, requiring more energy input and only for a small flow range.

In order to effectively atomize viscous liquids, effervescent atomization (EA) has been developed for highly viscous liquid applications. EA uses a two-phase flow concept to overcome the limitations of conventional injectors. In an effervescent atomizer, atomizing gas is pressurized into the liquid flow via pores on the mixing chamber wall to form two-phase flow upstream of the injector body. Gas bubbles expand and explode near the injector exit to break down the surrounding liquid phase into a fine spray. However, the internal two-phase flow regime might transit from bubbly flow to slug flow with large bubbles or annular flow with no bubbles. The slug flow regime produces pulsating spray because of the intermittent flow of large gas voids followed by liquid slugs. Annular flow has no bubbles, so no bubble explosion or liquid breakup occurs at the injector exit. Widespread application of effervescent atomization has been limited because of the two-phase flow instabilities in the injector and the high energy input required for pressurizing the gas into the liquid flow in the mixing chamber.

Recently, a flow-blurring (FB) injector has been developed to generate fine sprays (instead of typical jets) immediately at the injector exit, resulting in ultra-low emission combustion of fuels without fuel-preheating and hardware modification. These fuels include conventional diesel, biodiesel, and biodiesel's source oil (vegetable oil) and waste byproduct (straight glycerol), indicating the supreme atomization capability and fuel flexibility of a FB atomizer. FB injection concept is based on rapidly creating two-phase flow slightly upstream the injector exit, eliminating the slow bubble growth regime in the EA and thus avoiding the unstable spray pattern. In FB atomization, the atomizing air passes through a gap between the exit of the liquid tube and the concentric injector orifice at a distance H downstream of the liquid tube. FB was reported to be effective when the diameter D of internal liquid tube and injector orifice are identical and $H \leq 0.25D$. The atomizing air flow bifurcates at a stagnation point created between the liquid tube and orifice exit. A portion of the bifurcated air stream penetrates into the liquid tube forming a two-phase flow near the liquid tube exit while the other portion flows out through the orifice. The two-phase mixture (liquid and bubbles) experiences a sudden pressure drop while exiting the injector. Thus, bubbles expand and bursts, deforming the surrounding liquid into fine spray immediately at the injector exit, rather than typical liquid jet of a conventional AB atomizer.

Phase Doppler Particle Analyzer (PDPA) measurements show that the FB injector produces finer spray than that produced by an AB injector for the same atomizing air and liquid mass flow rates. Depending upon the design, a FB injector can also incur smaller pressure drop compared to an AB injector. For a given overall equivalence ratio, heat release rate (HRR), and atomizing air-to-liquid fuel mass ratio (ALR), FB atomization in a swirl-stabilized combustor resulted in three to five times lower carbon monoxide and nitrogen oxides emissions in diesel and kerosene flames compared to those employing AB atomization. Emissions measurements at the combustor exit have demonstrated that the FB injector can also results in clean combustion of straight VO. FB injector yields fine spray right at the injector exit rather than a liquid jet produced by the air-assist injector, signifying the greatly improved atomization capability of the former.

Figure 2A:
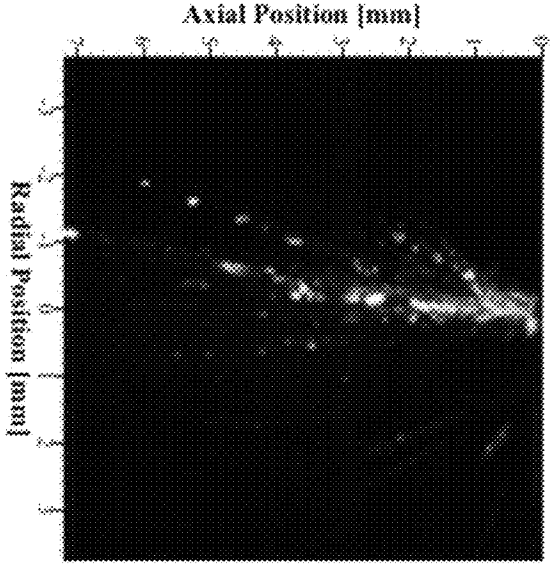
FIG. 2(*a*) provides a radial position versus axial position image of the spray generated by an air blast (AB) injector during particular flow conditions.
Figure 2B:
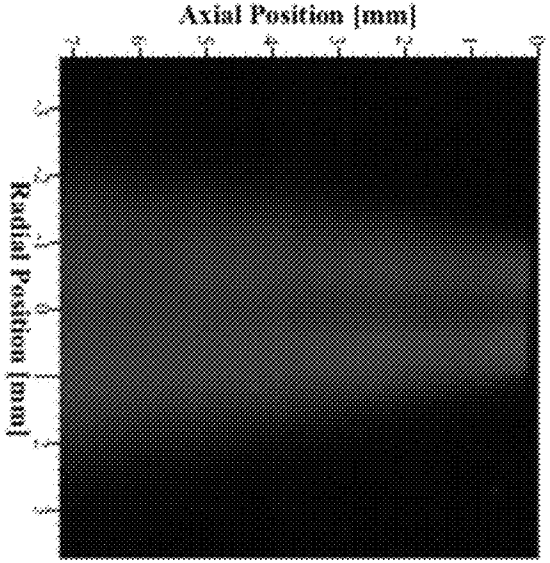

As shown in FIGS. 2(*a*) and (*b*), the FB injector generates fine and more stable sprays immediately at the injector exit. Laser Diagnostics by Particle Image Velocimetry (PIV) show that FB injector generates fine sprays, rather than a typical liquid jet of a conventional injector by the primary bubble explosion. FIGS. 3(*a*) and (*b*) show water droplets (which have an approximate diameter of 20 to 100 □m at ALR=2), and droplets and/or ligaments for highly viscous glycerol in the near field of the FB injector exit.

For highly viscous glycerol, previous spray imaging has shown droplets and ligaments are generated at injector exit. As shown in FIG. 4, the glycerol ligaments further break down into fine droplets at around 30 mm downstream of the injector exit by secondary atomization of shear layer instabilities between the high speed air and the liquid phase. This results in extended pre-vaporization zone and lifted glycerol flame, which is easily to be blown off Also, relatively larger droplets appear at the spray periphery, causing local diffusion burning or incomplete combustion, causing slightly higher carbon monoxide and nitrogen oxides emissions close to the combustor wall for viscous fuels (e.g. vegetable oil and glycerol).

SUMMARY OF THE INVENTION

The disclosed device enhances atomization and sustainably stabilizes spray and combustion, particularly for viscous fluids like VO and algae oil. The disclosed swirl burst (SB) injector incorporates swirling atomizing air with the flow blurring concept. Results from testing have shown that the SB injector achieves clean lean-premixed combustion of viscous and heavy source oils of biodiesel without preheating. This development provides significant cost savings and an increase in efficiency for conventional engines operated using low viscosity fuels.

Compared to the FB injector, SB injection results in enhanced atomization, and thus faster fuel pre-vaporization, improved fuel-air mixing, hence less lifted flames with ultra-low emissions. Swirl number (SN) of 2.0 is found to give the optimum SB injector geometry with lowest emissions among three tested SNs of 1.5, 2.0 and 2.4.

Spray characteristics using Particle Image Velocimetry quantitatively substantiate the further improved atomization of the SB injector. Pressure measurements in the flow line indicates the novel SB injection with high viscosity tolerance requires much lower energy input than the conventional AB injector, showing the promise of developing next-generation clean engines on heavy fuels with higher power-to-weight ratio. Compared to a FB injector, SB injection enhances the spray fineness without extra energy input.

DETAILED DESCRIPTION OF THE INVENTION

The subject matter of the present invention is described with specificity herein to meet statutory requirements. However, the description itself is not intended to necessarily limit the scope of the claims. Rather, the claimed subject matter might be embodied in other ways to include different steps or combinations of steps similar to the ones described in this document, in conjunction with other present or future technologies.

Furthermore, the described features, structures, or characteristics may be combined in any suitable manner into one or more embodiments.

The present invention improves the atomization of viscous liquids with smaller droplets, leading to faster vaporization, better fuel-air mixing, and consequently less lifted flames which are more sustained and stable, as well as lower emissions and improved efficiency.

In order to improve atomization—and consequently, sustain stable and clean flame for various fuels, especially highly viscous biofuels and other heavy fluids—the disclosed invention incorporates a swirl path for atomizing air with the flow-burst (FB) concept. Incorporation of the swirl path(s) results in better liquid-air mixing, lower emissions, reduced flame lifted length and thus, improved flame stability. Further, the swirling flow also improves atomization and local fuel-air mixing for stable flames of viscous fuels. Combustion tests, spray investigations, and data analysis have revealed the effectiveness of the disclosed design.

The disclosed device uses an internally mixing twin-fluid injector, hereinafter the swirl burst (SB) injector, by incorporating swirling atomizing air and the FB concept to enhance the atomization of viscous liquid fuels. In the FB concept, as shown in FIG. 1, a portion of the bifurcated atomizing air flows back into the internal liquid tube to form a two-phase flow leading to primary atomization. The other portion of the bifurcated atomizing air leaves the injector orifice assisting with the secondary disintegration of larger droplets at the spray edge and ligaments of viscous liquids. The disclosed SB injector additionally incorporates a swirling flow path on the injector exit route of the FB injector for the atomizing air leaving the injector orifice 4 in swirling pattern, shown in FIG. 5(*a*). The swirling atomizing air aerodynamically improves the shear layer interaction between the high-speed swirling air and the droplets and/or ligaments from the primary bubble bursting of viscous liquid fuels.

The swirl number (SN) defines the degree of swirl in the swirl burst injector. The SN is a non-dimensional number representing the axial flux of swirl momentum divided by the axial flux of axial momentum times the equivalent nozzle radius. The swirl number can be determined in geometrical terms by the following equation, wherein $d_h$ is the hub diameter, $d_t$ is the tip diameter of the swirl and $\alpha$ is the vane angle of swirl:

$$SN = \frac{2}{3}\left[\frac{1-\left(\frac{d_h}{d_t}\right)^3}{1-\left(\frac{d_h}{d_t}\right)^2}\right]\tan(\alpha)$$

Figure 5A:
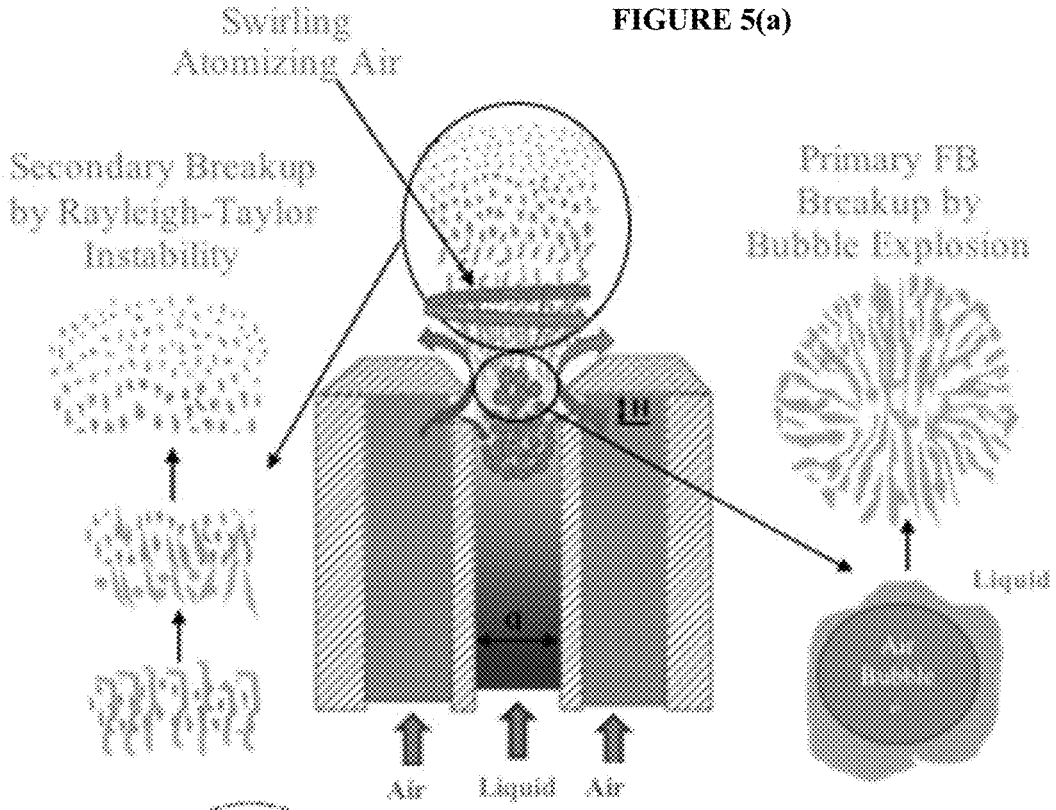
FIG. 5(*a*) provides a view of the working principle of the swirl burst injector integrating the swirling atomizing air effect and FB concept.
Figure 5B:
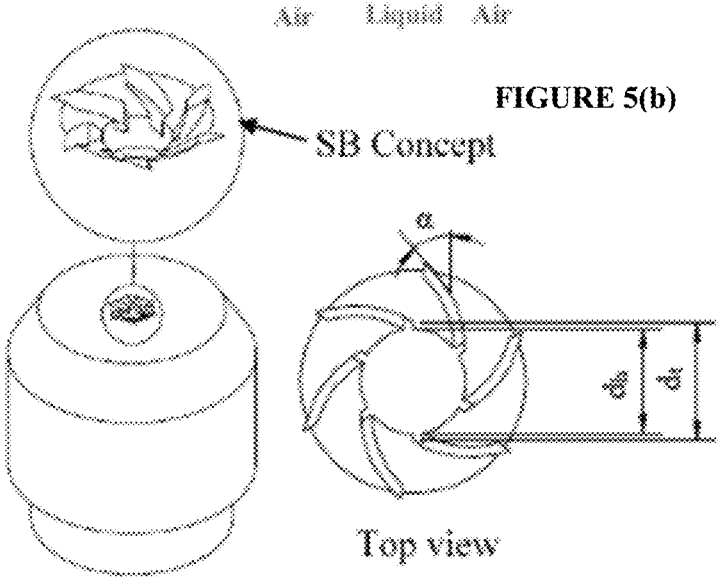

FIG. 5(*b*) depicts the preferred embodiment of the SB injector with a swirl number of 2.4.

The SB injector comprises a central internal liquid tubing 6 or port and an annulus atomizing air channel 7 surrounding the internal liquid tubing 6. In the embodiment in FIG. 5, there is a gap of H=0.25D between the liquid fuel tube tip and the injector orifice 4, with D being 0.06 inches (1.5 mm). The atomizing air leaves the injector orifice 4 with a swirling flow through a swirling path 2 generated on the chamfered injector exit 3 with an axial curved vane at a 70 degree angle with respect to the axial plane, giving a swirl number of approximately 2.4 shown in FIG. 5(*b*).

Figure 6A:
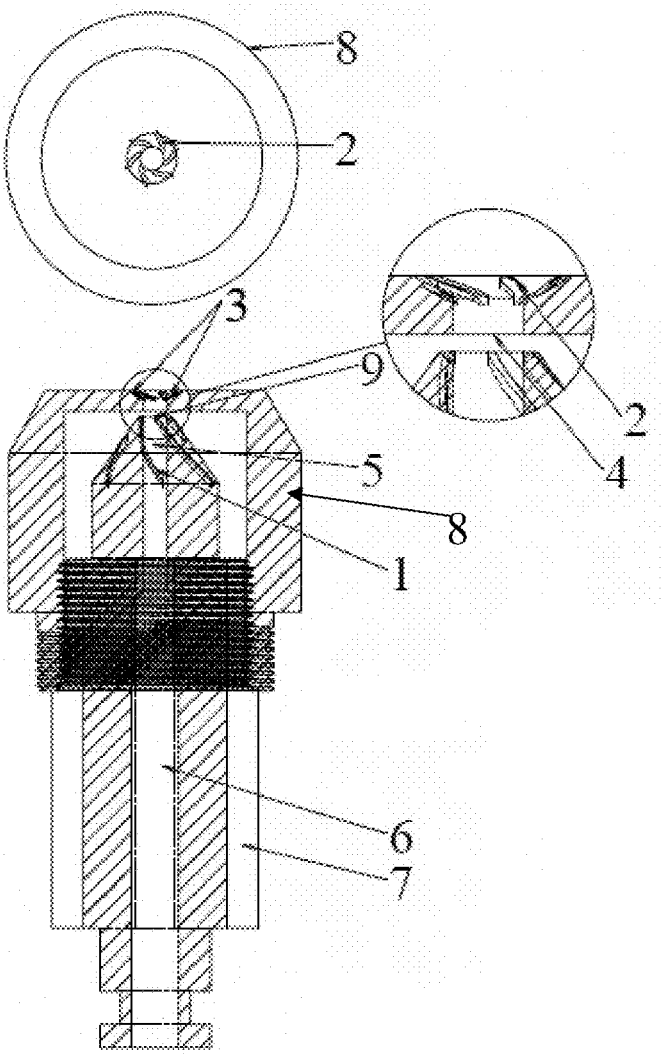
FIG. 6(*a*) depicts the design of the swirl burst (SB) injector with co-swirling paths 1 and 2.
Figure 6B:
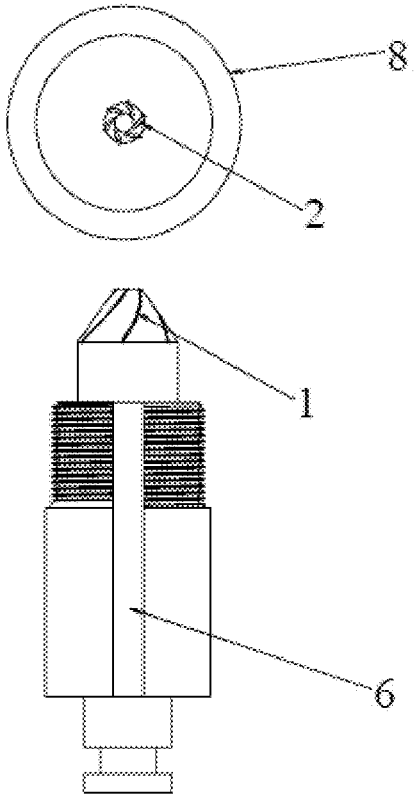

FIG. 6(*a*) depicts the swirling paths in the swirl burst injector. 1 identifies the swirling path with vanes on the tip of the internal liquid tubing 6 which directs part of the air penetrating into the internal liquid tubing 6 and forming an internal swirling bubbly flow at the tip 9, a location known as the "bubble generation zone" 5. The swirling flow pattern enhances interaction between air and liquid and form more bubbles in the center as well as on the edge. Subsequently, primary atomization by air bubble bursting is improved to yield finer droplets or thinner ligaments in the center and on the spray periphery, where relatively larger droplets were observed in a FB injector. 2 identifies an additional swirling path with vanes on the injector exit, leading the rest of the atomizing air leaving the injector in a swirling way. The swirling effect facilitates further disintegration of larger droplets/ligaments to rapidly form finer spray, enhancing fuel pre-vaporization, fuel-air mixing and thus efficient and clean premixed combustion. FIG. 6(*a*) indicates the co-swirl paths of 1 and 2 showing the same swirling direction, while FIG. 6(*b*) shows the counter-swirl paths of 1 and 2, i.e., the opposite swirl directions of the swirling path 1 on the outside wall of the internal liquid tube tip and the swirling path 2 on the injector exit 3 of the injector head 8.

Figure 7A:
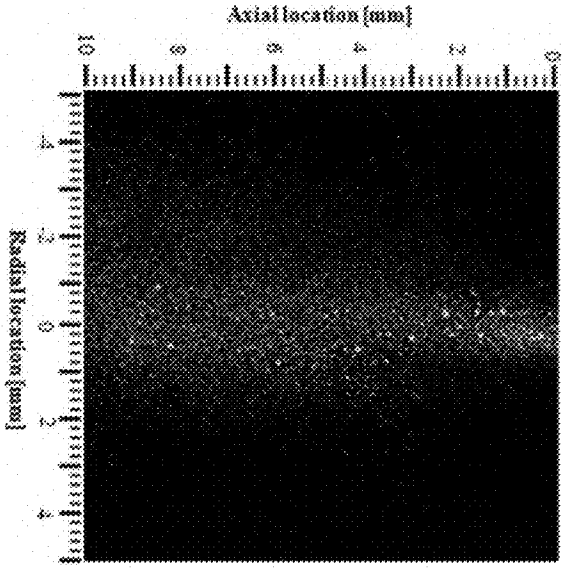
FIG. 7(*a*) shows a fine water spray generated by a FB injector at the injector near field with the FOV of 10 mm by 10 mm.
Figure 7B:
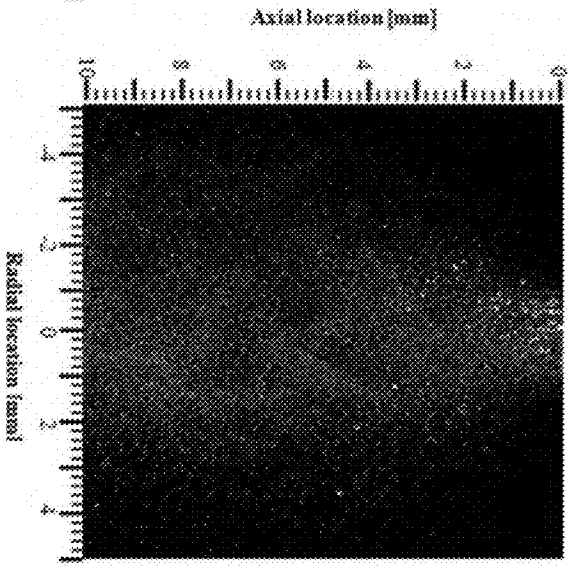

The disclosed swirl burst injector further enhances atomization with wider spray angle compared to a FB injector at the same flow rates. FIGS. 7(*a*) and 7(*b*) show the PIV spray images in the injector near field with FOV of 10 mm by 10 mm at spatial resolution of 7.14 μm per pixel for FB and SB injectors, respectively. White dots in the images represent atomized water droplets, surfaces of which scatter the incoming laser light into the camera sensor to form the spray images. The PIV laser with short pulse duration of 4 ns, i.e. the image exposure time, freezes the fast-moving droplets.

Majority of droplets near the injector orifice plane in both images are fine droplets ranging from around 28 μm in diameter with the maximum of about 107 μm, revealing the effective primary atomization by bubble bursting occurred slightly upstream of FB and SB injector exits (y=0 in). Compared to the FB spray at the injector near field (within 1 in downstream of the injector exit), less bright spots in FIG. 7(*b*) signify that finer droplets with less reflected light are formed by the SB injector. This can be attributed to the enhanced secondary atomization by the swirling atomizing air, which rapidly disintegrates the relatively larger droplets into fine ones in SB atomization. At further downstream, the SB spray contains only fine droplets while few larger droplets are observed at periphery of FB sprays. This comparison indicates that atomization is almost completed at the axial location of 0.08 in (2 mm) downstream of the SB injector orifice 4, indicating the further improved atomization capability and thus resulting in fast fuel evaporation and fuel-air mixing for efficient and clean combustion in real applications.

The disclosed swirl burst injector results in less lifted flame (FIG. 8(*b*)) to sustain the continuous burning of incoming fuel by the further enhanced atomization, compared to the FB VO flame in FIG. 8(*a*). Finer SB spray results in faster fuel pre-vaporization, better fuel-air mixing and rapid fuel oxidation, hence the shorter dark region indicative of fuel pre-vaporization and fuel-air mixing upstream the VO flame at the same ALR of 3.5.

The disclosed swirl burst injector incorporates the swirling impact with flow blurring atomization mechanism yielding finer sprays without extra pressure input, as shown in FIG. 8(*c*). The atomizing air pressure drop across the SB injector is about half of that in an AB atomizer, indicating less energy input to activate the superior, fine SB atomization. The effectiveness of the invention highly depends on the inter-relationship among the swirling vane angles of the swirling paths 1 and 2, which is a function of the disclosed swirl number, and the spray angle. The opening angle of the chamfered injector exit 3 will be determined according to the spray angle range from the primary bubble bursting affected by the swirling path 1. With the desired injector opening angle 3, the secondary swirling air through swirling path 2 can efficaciously interact with the larger droplets/ligaments from the primary breakup and hence improve the secondary liquid disintegration. Accordingly, the range of secondary swirling vane angle of 2 can be limited to avoid undesired turbulence.

The use of the SB injector provides benefits in efficiency and decrease in emissions as well as flame stability and sustainability. It was also investigated optimizing atomizing air to liquid mass ratio (ALR) can further produce cleaner emissions. This increase in combustion efficiency and cleanness were tested using the swirl number of 2.4 and a constant heat release rate (HRR) of 6.8 kW for straight VO, which yielded a fuel flow rate of 11.8 milliliters per minute (mlpm). The investigation included ALRs of 3.0, 3.5, and 4.0 by varying the flow rate of the atomizing air.

Figures 9A, 9B, 9C:
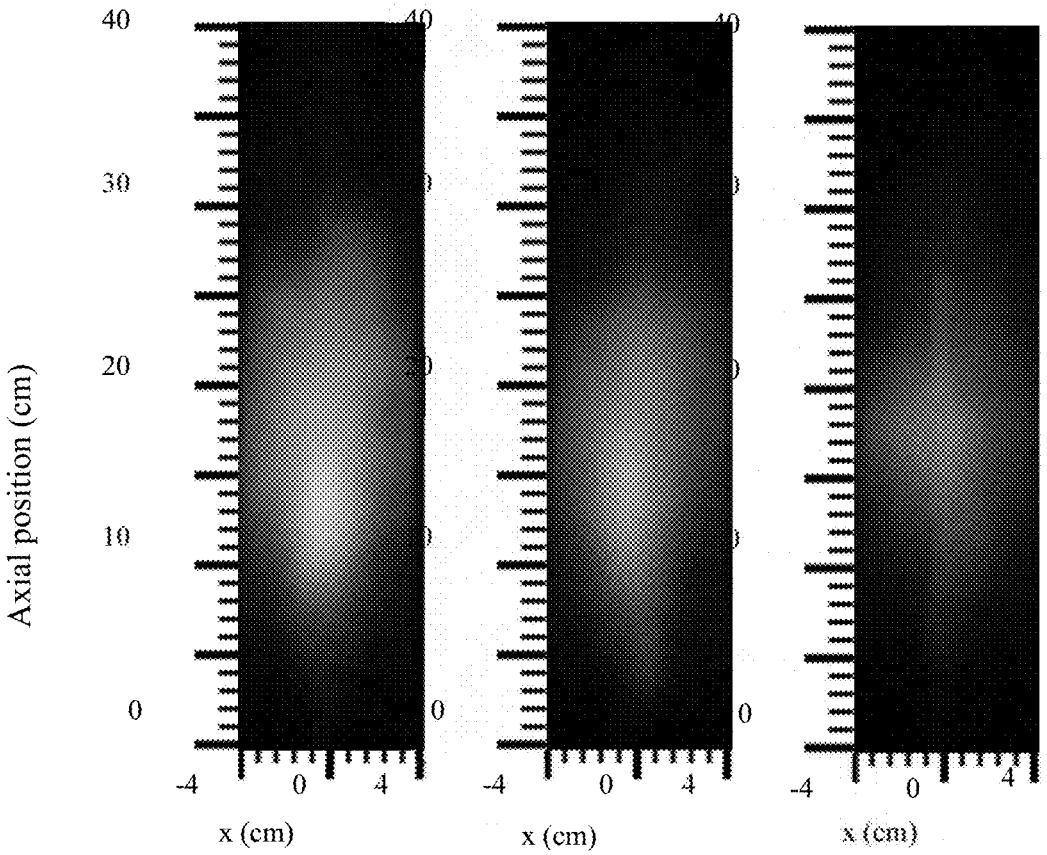
FIG. 9(*a*) is the flame image for combustion of straight vegetable oil (VO, soybean oil in the figure) without fuel preheating using the SB injector at an air to liquid mass ratio (ALR) of 3.0 having an upstream dark zone, i.e. fuel pre-vaporization and fuel-air mixing zone, with length of approximately 6 centimeters downstream of the injector exit plane.

FIGS. 9(*a*), (*b*), and (*c*) depict the visual flame image from the combustion of straight VO using the SB injector at varying ALRs. The flame images are similar qualitatively with minor visual differences. The flame color becomes dominantly blue with an increase in ALR, which can be ascribed to finer droplets evolution at the higher ALR, aiding fast and complete pre-vaporization and fuel mixing and hence cleaner combustion. As depicted in FIG. 9(*c*) when compared to FIGS. 9(*a*) and (*b*), the shorter flame length at an ALR of 4.0 is due to the finer droplets obtained at a higher ALR, coupled with enhanced secondary atomization provided by the SB injector, hence quickly evaporating, mixing well with air, and yielding fast fuel oxidation.

Figure 10:
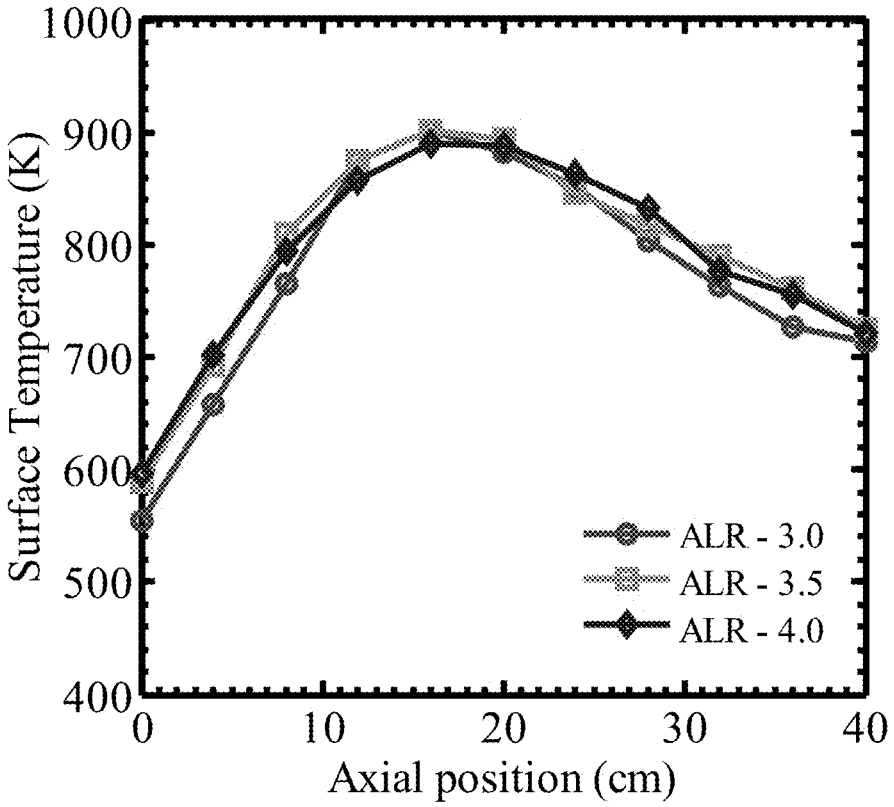
FIG. 10 provides the resulting surface temperature distribution of the combustor outside wall at the investigated ALRs.

FIG. 10 provides the resulting surface temperature distribution of the combustor outside walls at the investigated ALRs. As seen in FIG. 10, the surface temperature increases along the flow (axial) direction to a peak and then gradually reduces further downstream. The slightly lower surface temperature near the dump plane at ALR of 3.0 corroborates the lifted flame obtained at this ALR due to relatively larger droplets at lower ALR resulting in slower fuel pre-vaporization and fuel-air mixing. The peak of the surface temperature profile coincides for all tested ALRs at approximately 15 centimeters downstream of the injector exit plane, indicating a relatively close reaction zone obtained with the SB injector at different ALRs.

Figure 11:
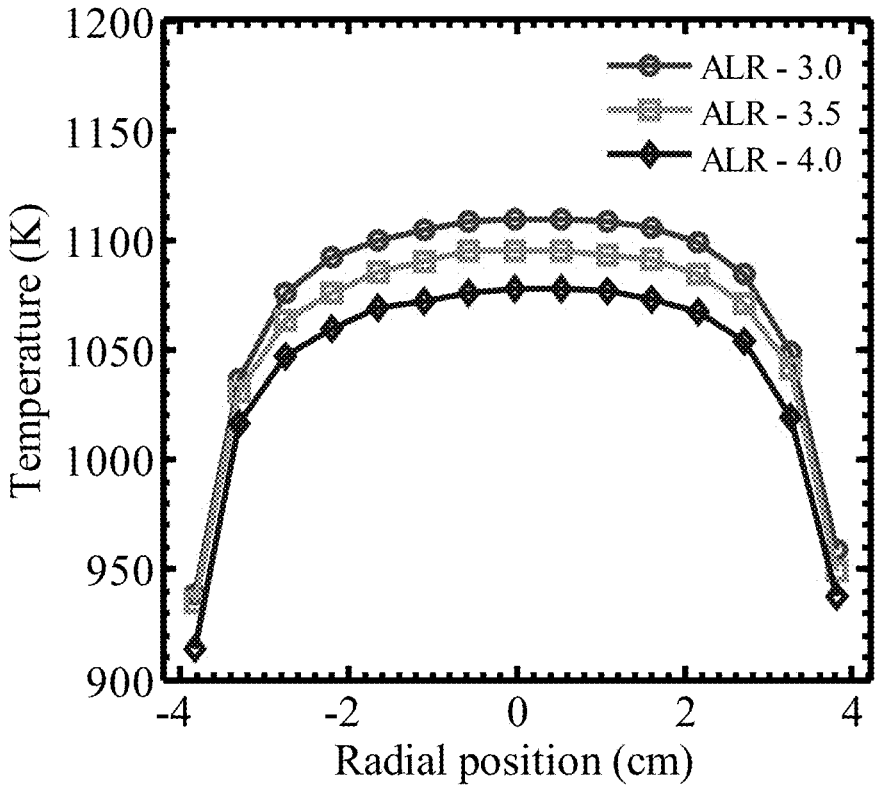
FIG. 11 shows the radial profile of the product gas temperature (uncorrected) at the combustor exit plane from the combustion of VO using the SB injector at different ALRs.

FIG. 11 shows the radial profile of the product gas temperature (uncorrected) at the combustor exit plane from the combustion of VO using the SB injector at different ALRs. The symmetric profile of the product gas temperature is apparent across all ALRs, validating the ability of the SB injector to achieve better uniform fuel-air mixture and even droplet size distribution.

Figure 12:
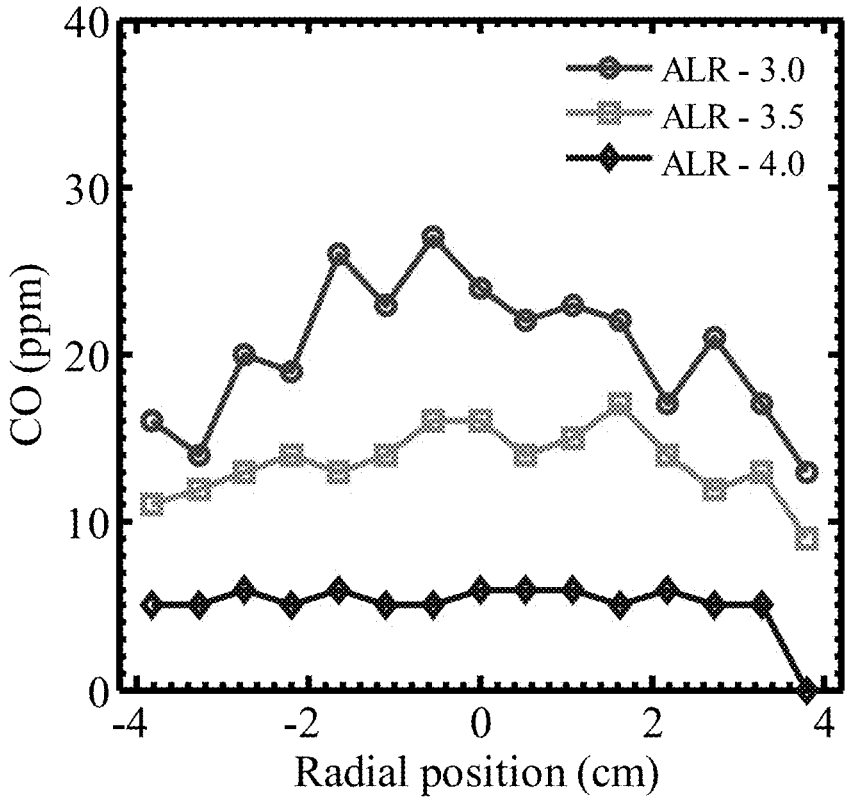
FIG. 12 provides the radial profile of the carbon monoxide emissions at the combustor exit from the combustion of VO using the SB injector at different ALRs.

FIG. 12 provides the radial profile of the carbon monoxide emissions at the combustor exit from the combustion of VO using the SB injector at different ALRs. The CO emission obtained at ALR of 3.0 was approximately 15-26 ppm, 11-16 ppm for ALR of 3.5, and 0-5 ppm for ALR at 4.0. The difference in the CO emissions obtained at different ALRs can be attributed to enhanced fuel atomization by the SB injector at higher atomizing air flow rates and improved fuel air mixing, and hence more complete and cleaner lean-premixed combustion. Overall, the SB injector achieved clean, primarily lean pre-mixed combustion of viscous VO across all ALRs, and the ALR of 4.0 resulted in the cleanest emissions.

Figure 13:
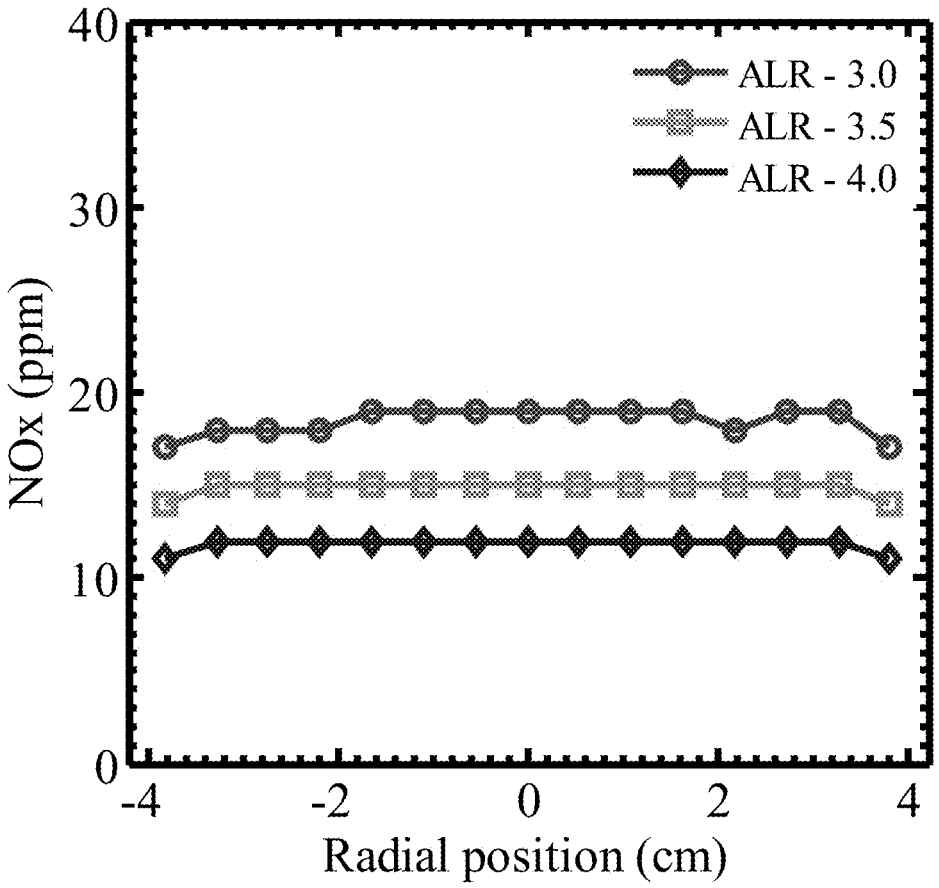
FIG. 13 illustrates the radial profile of the nitrogen oxides emissions at the combustor exit from burning straight VO using the SB injector at different ALRs.

FIG. 13 illustrates the radial profile of the nitrogen oxides emissions at the combustor exit from burning straight VO using the SB injector at different ALRs. Ultra-low nitrogen oxides emissions, within 10-20 ppm, were obtained at all ALRs, signifying the SB injector's proficiency at obtaining clean combustion of viscous VO. A decrease in the ALR resulted in higher nitrogen oxides concentrations, signifying relatively larger droplets at lower ALR burning at diffusion mode with higher local temperature, and thus, higher thermal nitrogen oxides because of the thermal nitrogen oxides mechanism, which favors high temperatures. ALR of 4.0 achieved the lowest nitrogen oxides emissions (approximately 0-10 ppm) which can be attributed to the more efficient atomization at the higher ALRs and the lower local temperatures of the lean premixed combustion.

To test the performance of the SB injector with other viscous fluids, the disclosed SB injector was tested using algae oil without fuel preheating at constant flow rates and an ALR of 4.0, which has been demonstrated above to yield ultra-low emissions. Those having ordinary skill in the art will recognize that the use of other ALRs is possible.

Figures 14A, 14B, 14C:
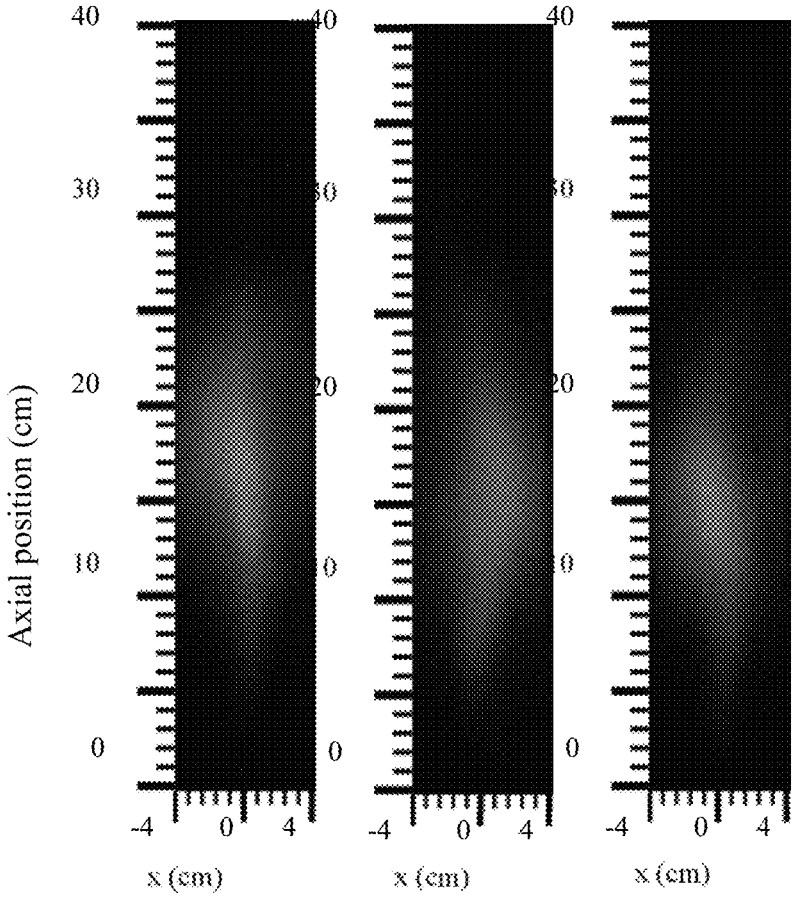
FIG. 14(*a*) depicts the visual flame images of the combustion of algae oil (AO) using the swirl burst injectors with a swirl number (SN) of 1.5 at an ALR of 4.0 and constant flow rates.

FIGS. 14(*a*), (*b*), and (*c*) depict the visual flame images of the combustion of algae oil (AO) using the swirl burst injectors with different SNs at ALR of 4.0 and constant flow rates. The dominant blue color of the flame images signifies clean complete combustion of the hydrocarbons (CH-chemiluminescence). The dark regions upstream of flames for all the three test cases signify fuel pre-vaporization and fuel-air mixing before fuel oxidation, indicating mainly premixed combustion achieved for all SNs because of the superior SB atomization capability. FIGS. 14(*a*), (*b*), and (*c*) show dark zone length of approximately 7 centimeters, 6 centimeters, and 5 centimeters upstream of the flames, respectively for the injector with an SN of 1.5, 2.0 and 2.4, corresponding to the axial curve vane angles, a in FIG. 5(*a*), of at 60, 65 and 70-degree respectively. The increasing momentum of swirling atomizing air (SAA) in the radial direction for higher SN results in more vigorous interaction between the SAA and the relatively larger droplets from primary bubble bursting, hence generating smaller droplets immediately at the injector exit with faster fuel evaporation. The increased radial momentum of SAA also enhances the fuel-air mixing with the thermal feedback from combustion gas products, further quickening the fuel vaporization, followed by faster fuel oxidation.

Figure 15:
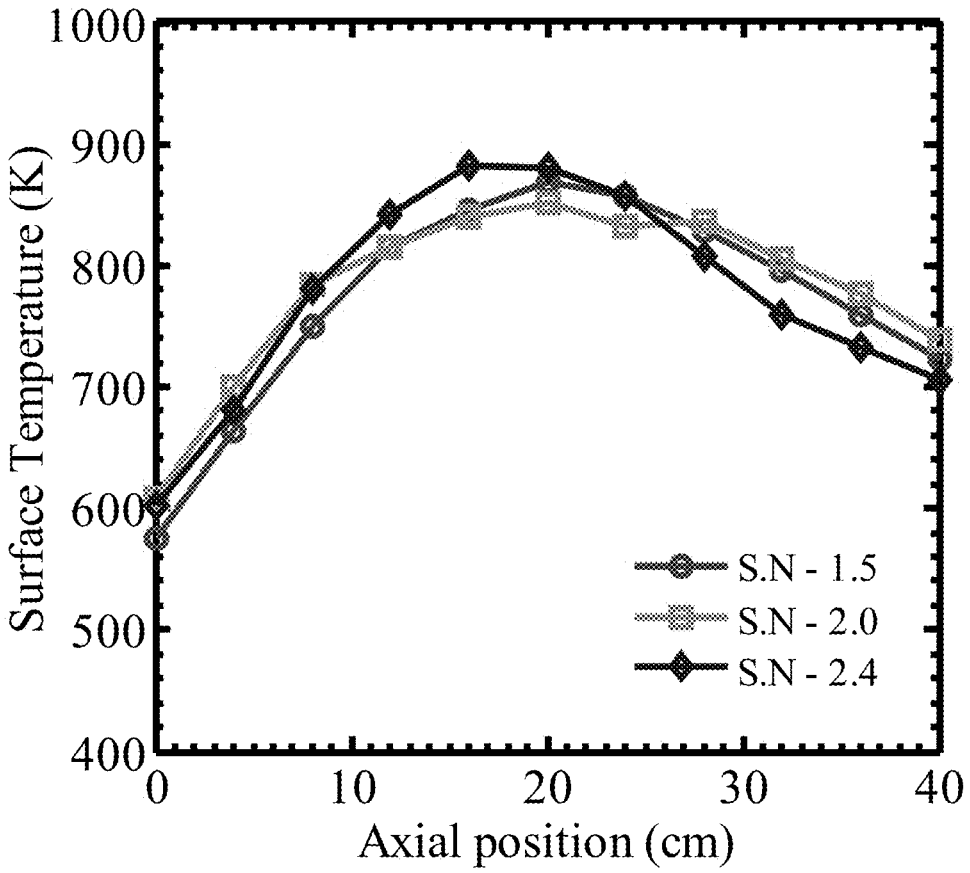
FIG. 15 shows the temperature distribution of the combustor outside wall for AO using the SB injector with different injector SNs.

FIG. 15 shows the temperature distribution of the combustor outside wall for AO using the SB injector with different injector SNs. The temperature profile increases in the flow direction and reaches a peak before decreasing further downstream, signifying the fuel evaporation, fuel oxidation achieving highest temperature, followed by lower temperatures because of the complete combustion and products mixing. The nearly overlapped temperature profiles of all three SNs indicate that complete combustion of straight AO, irrespective of swirl number, using the SB injection without fuel preheating can be achieved.

Figure 16:
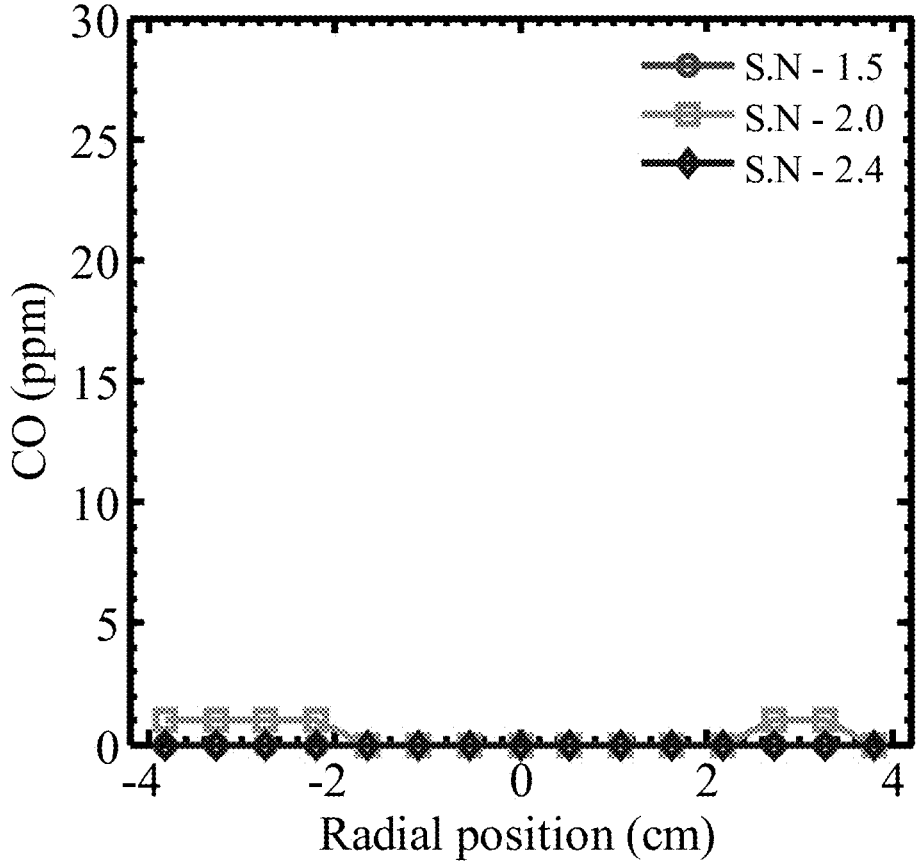
FIG. 16 illustrates the radial profile of carbon monoxide emissions at the combustor exit from the combustion of AO using the SB injector with different SNs.

FIG. 16 illustrates the radial profile of carbon monoxide emissions at the combustor exit from the combustion of AO using the SB injector with different SNs. Nearly none of the carbon monoxide emissions of straight AO was detected at the combustor exit for all investigated SNs. This result further indicates that complete and clean combustion of straight AO is achieved through the further enhanced atomization capability of the SB injector.

Figure 17:
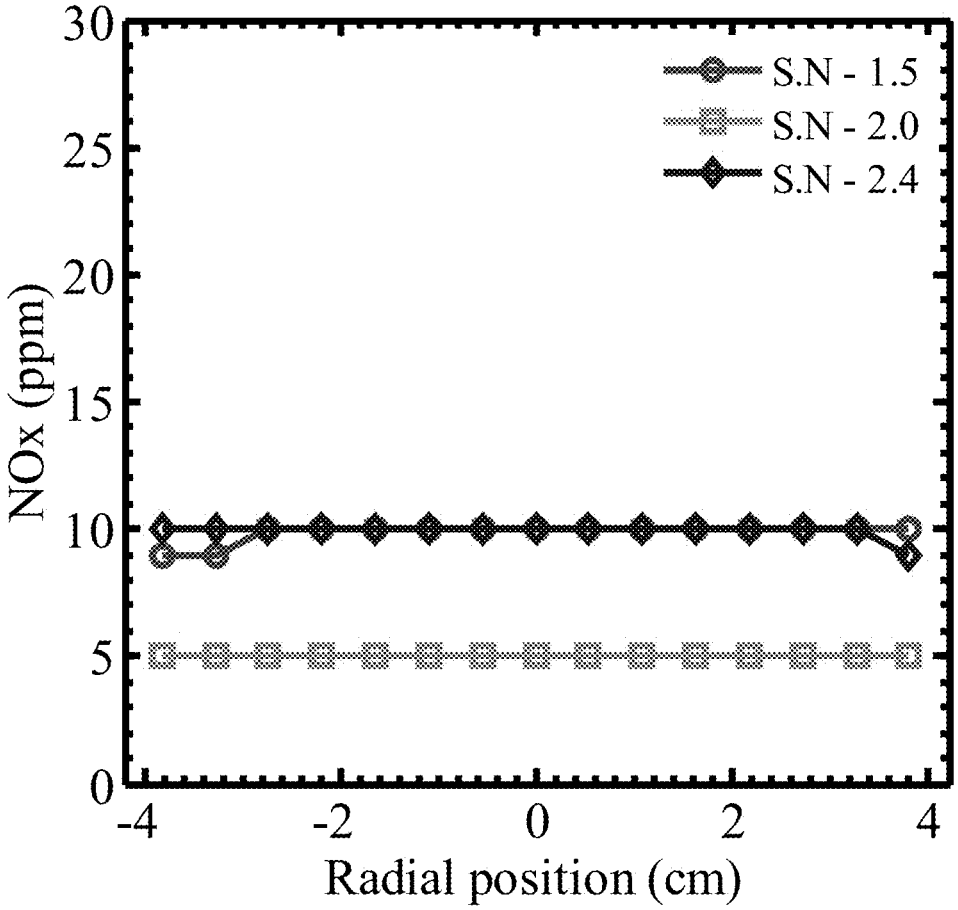
FIG. 17 depicts the radial profile of nitrogen oxides emissions at the combustor exit from the combustion of pure algae oil using the SB injector with different SNs.

FIG. 17 depicts the radial profile of nitrogen oxides emissions at the combustor exit from the combustion of pure algae oil using the SB injector with different SNs. The SB injectors produced ultra-low nitrogen oxides emission in the range of 5-10 ppm further validating the ability of the SB injector to achieve clean combustion of heavy and viscous AO. The SN of 2.0 yielded the lowest nitrogen oxides emissions by the combined benefit of enhanced atomization and appropriate axial velocity to achieve less lifted flame with lower local reaction temperature and thus minimize thermal nitrous oxide.

Figure 18:
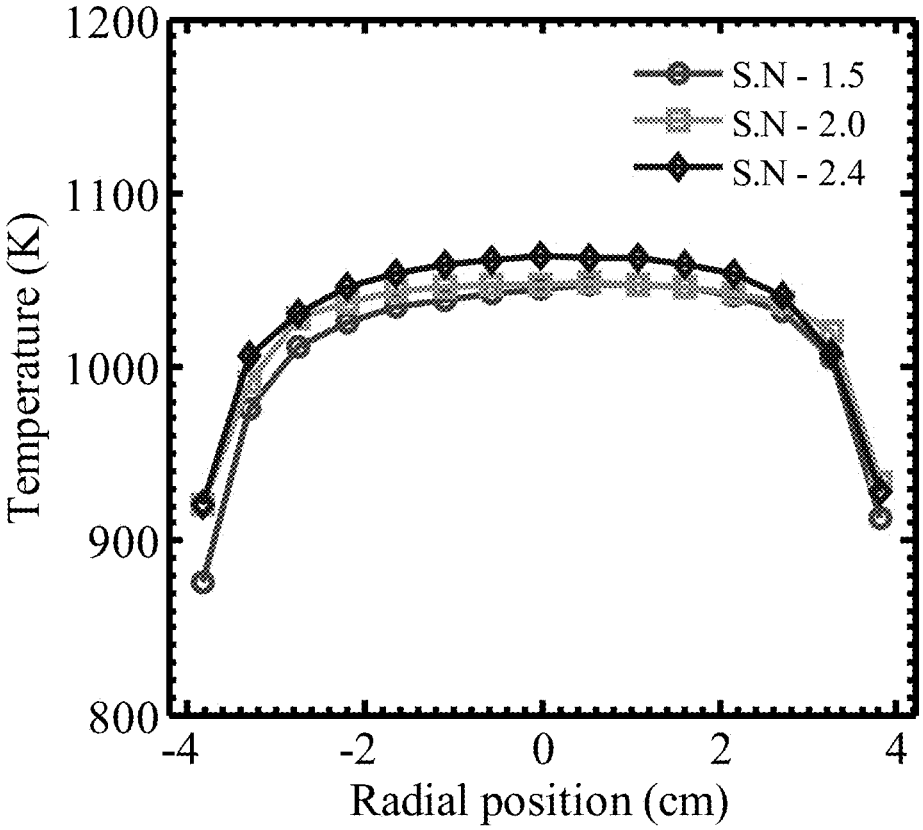
FIG. 18 depicts the radial profile of product gas temperature for the SB injector with varying swirl number.

FIG. 18 illustrates the radial profile of the product gas temperature at the combustor exit from the burning of AO using the SB injectors with different SNs. The symmetric profile of the product gas temperature consistently signifies the uniformity of the fuel air mixture and even droplet size distribution achieved by the swirling secondary atomizing air of the SB injector. The lower temperatures obtained at the combustor walls consistently validates the heat loss to the surrounding through the combustor wall from convective and radiative heat loss. Overall, clean premixed combustion of straight AO is achieved using the disclosed SB injector.

Particularly, it has been shown by testing of the SB injector that the ALR of 4.0 and an SN greater than 1.5 and less than 2.4 ($1.5<SN<2.4$) is the preferred dimensions for viscous oils, including but not limited to algae oil. Because this performance is scalable, those having ordinary skill in the art will recognize that the same performance would be achieved for higher heat release rates or different diameter sizes for the SB injector. Those having ordinary skill in the art will also recognize that SNs and ALRs outside of these dimensions can also be applied with the SB injector.

Comparing the pressure drops for atomizing air lines across injectors also demonstrates that the SB injector requires less energy input compared to a typical AB injector. FIG. 8 demonstrates the pressure drop in the atomizing air line across the injector increases with increasing ALR due to the varying flow rate and constant liquid flow rate. The pressure drop in the atomizing air line of the SB injector is lower than the conventional AB injector, signifying less energy input for fuel atomizers with superior atomization capability. Pressure drop in atomizing air across the injector is almost the same for the FB and SB injectors all ALR. This result indicates that SB injector improves the atomization by the SAA without requiring extra energy input compared to a FB injector. In summary, the SB injector further enhances the atomization capability for heavy and viscous fuels with much lower energy input required compared to a typical AB injector, potentially enabling more compact clean engines of heavy fuels with higher power to weight ratio.

While the disclosed invention was designed for use in liquid injection technologies, the features and advantages of this design described in this application can be utilized by a number of different industries. Beside clean and stable combustion application, the present invention can also be used for fire suppression atomizer, food processing, viscous polymer spraying, and other applications where fine spray is needed with its high viscosity tolerance and liquid flexibility.

The described features, advantages, and characteristics may be combined in any suitable manner in one or more embodiments. One skilled in the relevant art will recognize that the various components of this design may be practiced without one or more of the specific features or advantages of a particular embodiment. In other instances, additional features and advantages may be recognized in certain embodiments that may not be present in all embodiments.

Reference throughout this specification to "one embodiment", "an embodiment", or similar language means that a particular feature, structure, or characteristic described in connection with the embodiment is included in at least one embodiment. Thus the appearance of the phrase "in one embodiment", "in an embodiment", and similar language throughout this specification may, but do not necessarily, all refer to the same embodiment.

I claim:

1. A swirl burst fuel injector comprising:

(a) an internal liquid tubing, comprising a liquid tip end with chamfered outside wall;

(b) an injector head;

(c) a chamfered injector exit;

(d) a bubble generation zone;

(e) one or more swirling paths;

(f) at least two swirling vanes;

(g) an atomizing gas channel;

(h) an injector orifice;

wherein a gap is present between the injector orifice and the liquid tip end, wherein gas bifurcation occurs wherein a portion of a gas flows into the bubble generation zone and a remaining portion of said gas exits through the chamfered injector exit;

wherein bubbles are formed in the portion of the gas flowing into the bubble generation zone;

wherein the at least two swirling vanes are contained in each swirling path; and wherein at least one of the swirling paths delivers gas into the bubble generation zone in a swirling mode;

wherein a mixing of the gas and the liquid occurs prior to its arrival at the chamfered injector exit;

wherein said bubbles undergo a pressure drop while passing through the chamfered injector exit; and wherein said pressure drop causes said bubbles to burst into fine droplets upon exiting the chamfered injector exit.

2. The swirl burst fuel injector of claim 1, wherein the size of the gap between the injector orifice and the liquid tip end is equal to or less than one-fourth the size of the diameter of the internal liquid tubing.

3. The swirl burst fuel injector of claim 1, wherein at least one of the swirling paths delivers gas outside of the injector through the injector exit in swirling mode.

4. The swirl burst fuel injector of claim 1, wherein the swirling vanes are angled; and wherein said angle and vane dimension are identified as the swirl number.

5. The swirl burst fuel injector of claim 4, wherein the swirl number is at least 1.5.

6. The swirl burst fuel injector of claim 1, wherein at least two of the swirling vanes are located on the chamfered outer wall of the injector orifice and that of the liquid tube tip; and wherein at least two of the swirling vanes on the injector orifice and the liquid tube tip operate in the same direction.

7. The swirl burst fuel injector of claim 1, wherein at least two of the swirling vanes are located on the injector orifice and the liquid tube tip; and wherein at least two of the swirling vanes on the injector orifice and the liquid tube tip operate in different directions.

8. The swirl burst fuel injector of claim 1, wherein during operation of the swirl burst fuel injector, a gas and a liquid pass through said injector; and wherein a ratio of the gas' mass and the liquid's mass is 4.0.

9. The swirl burst fuel injector of claim 1, wherein at least one of the swirling paths also delivers gas into a spray field of the injector exit in a swirling mode.

10. The swirl burst fuel injector of claim 1, wherein the internal liquid tubing's inside diameter is equal to the injector orifice's diameter.

11. The swirl burst fuel injector of claim 1, wherein the liquid tip is located upstream of the injector orifice.

12. The swirl burst fuel injector of claim 1, wherein the injector head comprises an orifice located in the injector head's center, and where the chamfered injector exit is constructed around the orifice on the orifice's outer wall.

* * * * *